US007056048B2

(12) United States Patent
Braun et al.

(10) Patent No.: US 7,056,048 B2
(45) Date of Patent: Jun. 6, 2006

(54) SYSTEM FOR ENSURING CORRECT PLACEMENT OF PRINTED MATTER ON A TANGIBLE PRINT MEDIUM

(75) Inventors: John F. Braun, Fairfield, CT (US); David Wittenberg, Fairfield, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/878,885

(22) Filed: Jun. 28, 2004

(65) Prior Publication Data

US 2005/0286956 A1 Dec. 29, 2005

(51) Int. Cl.
*B41J 11/58* (2006.01)
*B41J 33/14* (2006.01)

(52) U.S. Cl. ..... 400/630; 400/234

(58) Field of Classification Search ..... 400/630, 400/234, 223, 225, 249, 711, 708, 120.17; 347/188, 197; 399/484, 299
See application file for complete search history.

(56) References Cited

U.S. PATENT DOCUMENTS 3,998,313 A * 12/1976 Hickey ..... 400/616.2
5,823,692 A * 10/1998 Tolrud et al. ..... 400/582
5,959,652 A * 9/1999 Privin ..... 347/214
6,190,066 B1 * 2/2001 Ishigouoka et al. .... 400/120.01
6,390,703 B1 * 5/2002 Kinas et al. ..... 400/708
6,428,222 B1 * 8/2002 Dunham ..... 400/247
6,633,740 B1 * 10/2003 Estabrooks ..... 399/384
6,768,502 B1 * 7/2004 Milton ..... 347/197
6,788,324 B1 * 9/2004 Fisher et al. ..... 347/188

* cited by examiner

*Primary Examiner*—Andrew H. Hirshfeld
*Assistant Examiner*—Wasseem H. Hamdan
(74) *Attorney, Agent, or Firm*—Ronald Reichman; Angelo N. Chaclas

(57) ABSTRACT

A system for ensuring that printed matter is properly printed on a print medium including a printer having a feeding device and a plurality of detecting devices disposed along a length of the feeding device. The print medium has a plurality of signaling components, and each of the detecting devices is able to detect the presence of each of the signaling components. The system determines a first feed orientation of the print medium based on an order in which the detecting devices detects the presence of the signaling components when the print medium is being fed into the printer. Alternatively, the first feed orientation may be based on identifying information contained in the signaling components. The printer causes the printed matter to be printed in a proper location and in a proper orientation on the print medium based on the first feed orientation.

6 Claims, 6 Drawing Sheets

SYSTEM FOR ENSURING CORRECT PLACEMENT OF PRINTED MATTER ON A TANGIBLE PRINT MEDIUM

FIELD OF THE INVENTION

The present invention relates to printers and printing, and in particular to a system for ensuring correct placement of printed matter on a tangible print medium.

BACKGROUND OF THE INVENTION

Printers, used in conjunction with computers and specialized computer applications, are widely used to print many types of printed matter on various items such as paper, envelopes and the like (hereinafter referred to as "print media" and individually as a "print medium"). Certain types of print media, such as envelopes, preprinted forms, preprinted letterhead, and photo paper, require the printed matter to be particularly placed and oriented on the print media to be aligned properly with the preprinted or other structural features thereof For example, a letter printed on a piece of letterhead must, be properly aligned with the preprinted information on the letterhead and must be printed on the proper side of the letterhead. Similarly, a postal indicia must be printed on the proper part and proper side of an envelope. Thus, certain types of print media may be said to be orientation sensitive.

The problem is that users often do not know how to correctly orient the orientation-sensitive print media in their printers so that the printed matter is printed onto the proper locations of the print media. This problem, which most often results in misprinting, leads to wasted time, printer jams, wasted print media, and in the case of postal indicia, wasted money. Current solutions for this problem include printer instruction manuals and icons or the like placed on the feeder trays of printers that attempt to instruct the user on the proper orientation of print media. These manuals and icons are often difficult to interpret and understand, leading to confusion and frustration on the part of the user.

SUMMARY OF THE INVENTION

In one embodiment, the present invention relates to a system for ensuring that printed matter is properly printed on a print medium including a printer having a feeding device for facilitating the feeding of the print medium into the printer and a plurality of detecting devices disposed along a length of the feeding device. The print medium has a plurality of signaling components, and each of the detecting devices is able to detect the presence of each of the signaling components when each of the signaling components is in proximity to the detecting device. The system in this embodiment determines a first feed orientation of the print medium based on an order in which each of the detecting devices detects the presence of a respective one of the signaling components when the print medium is being fed into the printer. The printer then causes the printed matter to be printed in a proper location and in a proper orientation on the print medium based on the first feed orientation.

In an alternative embodiment, the present invention relates to a system for ensuring that printed matter is properly printed on a print medium including a printer having a feeding device for facilitating the feeding of the print medium into the printer and a plurality of detecting devices disposed along the length of a feeding device. In this embodiment, the print medium includes a plurality of signaling components, and each of the signaling components contains identifying information for identifying the signaling component. Each of the detecting devices is able to detect the presence of and obtain the identifying information from each of the signaling components when each of the signaling components is in proximity to the detecting device. The system in this embodiment determines a first feed orientation of the print medium based on the identifying information received by each of the detecting devices when the print medium is being fed into the printer. The printer then causes the printed matter to be printed in a proper location and in a proper orientation on the print medium based on the first feed orientation.

According to yet another embodiment, the present invention relates to a system for ensuring that printed matter is properly printed on a print medium including a printer having a feeding device for facilitating the feeding of the print medium into the printer and first and second print heads, wherein the feeding device has a top portion and a bottom portion and wherein the print medium is fed in between the top portion and the bottom portion. In addition, the system includes a plurality of first detecting devices disposed along a length of the bottom portion of the feeding device and a plurality of second detecting devices disposed along a length of the top portion of the feeding device. The print medium in this embodiment includes a plurality of signaling components, and each of the first and second detecting devices is able to detect the presence of each of the signaling components when each of the signaling components is in proximity to the detecting device. The system determines a first feed orientation of the print medium based on either an order in which each of the first detecting devices detects the presence of a respective one of the signaling components or an order in which each of the second detecting devices detects the presence of a respective one of the signaling components when the print medium is being fed into the printer between the top and bottom portions. The printer in this embodiment causes the printed matter to be printed in a proper location and in a proper orientation on the print medium based on the first feed orientation using the first print head if the first detecting devices detect the signaling components and the second print head if the second detecting devices detect the signaling components. In this embodiment, the first print head is adapted to print on a first surface of the print medium and the second print head is adapted to print on a second surface of the print medium, wherein the two surfaces are opposite one another.

In any of the described embodiments, the printer may print the printed matter using a print rendering appropriate for the first feed orientation. Alternatively, the printer may further include a paper handling system, wherein the paper handling system changes the print medium from the first feed orientation to a second feed orientation if the print rendering used to print the printed matter is appropriate for the second feed orientation and not appropriate for the first feed orientation. In addition, in any of the described embodiments, the signaling components may be carbon or other types of ink spots, and the detecting devices may be infrared LED transmitters/receivers, where the carbon or other types of ink spots absorb infrared light, and the absence of reflected infrared light is a signal that the spot has been detected. Alternatively, the signaling components may be RFID tags, and the detecting devices may be RFID receivers.

Therefore, it should now be apparent that the invention substantially achieves all of the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PREFERRED EMBODIMENTS

Figure 1A:
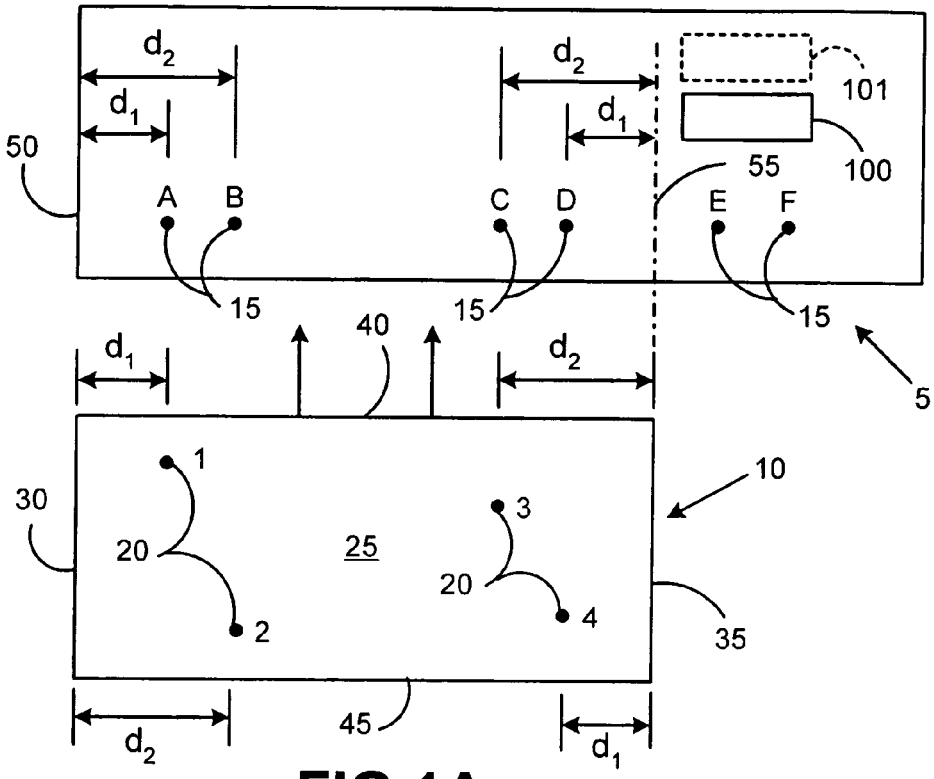
FIGS. 1A, 1B, 2A, and 2B are block diagrams of a system for ensuring proper printing of printed matter onto a print medium according to one embodiment of the present invention.

FIG. 1A shows feeder tray 5 and print medium 10, such as an envelope, according to one embodiment of the present invention. Print medium 10 has a standard size that is common among all print media of the same type, such as a standard #10 envelope. Feeder tray 5 is a feeder tray forming a part of a printer, such as a laser printer. Print media onto which printed matter is to be printed are placed on feeder tray 5 and are fed into the printer where the actual printing occurs. It will be appreciated that some other feeding device or mechanism that is provided with the detecting devices 15 as described herein may be substituted for feeder tray 5 without departing from the scope of the present invention.

Feeder tray 5 shown in FIG. 1A is provided with a number of detecting devices 15. Detecting devices 15, described in greater detail below, are able to detect when signaling components 20 provided on print medium 10 are in close proximity thereto. For reasons to be described below, detecting devices 15 are placed in particular locations on feeder tray 5. For convenience, detecting devices 15 are labeled A, B, C, and D.

Print medium 10 has a front surface 25, a left edge 30, a right edge 35, a top edge 40, and a bottom edge 45. In the embodiment shown in FIG. 1A, front surface 25 is the surface of print medium 10 onto which the printed matter is to be printed, and as such, the printer associated with feeder tray 5 feeds print media "face up." Print medium 10 has provided thereon or embedded therein, on the side opposite front surface 25, a number of signaling components 20. Signaling components 20 are placed at the locations indicated by the dots in FIG. 1A.

Each signaling component 20 is a device or a mark that is able to be sensed or detected by a detecting device 15 when the signaling component 20 is in close proximity thereto. Thus, as will be appreciated, the type of detecting device 15 used in a particular embodiment of the present invention will depend upon the type of signaling component 20 used. In one embodiment, signaling components 20 are carbon ink spots, and detecting devices 15 are infrared LED transmitter/receiver units that are able to detect the presence of reflected infrared light, with the carbon ink spots absorbing the infrared light, and all other surfaces reflecting the infrared light when they intersect the infrared beam of the transmitter/receiver units. In another embodiment, signaling components 20 are spots made of an ink that reflects in the non-visible range, such as the infrared or ultraviolet ranges, and detecting devices 15 are detectors that can detect reflected light in the same non-visible range with the non-visible ink reflecting a different frequency than the medium upon which the non-visible ink spot is placed. In still another embodiment, signaling components 20 are miniature radio frequency identification (RFID) tags that are embedded in print media 10 and detecting devices 15 are miniature RFID readers that have a very small transmission range, preferably on the order of 0.5 mm. Such RFID tags and RFID readers are known in the art. The RFID tags are typically passive components that become energized and emit an RF signal when they come within the transmission range of a compatible RFID reader. The RFID reader is able to receive the emitted RF signal and thus is able to detect the present of the RFID tag.

Referring again to FIG. 1A, signaling components 20 are labeled 1, 2, 3 and 4 for convenience. Signaling component 20 identified as 1 is placed at a location as shown in FIG. 1A that is a fixed distance $d_1$ from left edge 30, signaling component 20 identified as 2 is placed at a location as shown in FIG. 1A that is a fixed distance $d_2$ from left edge 30, signaling component 20 identified as 3 is placed at a location as shown in FIG. 1A that is the same fixed distance $d_2$ from right edge 35, and signaling component 20 identified as 4 is placed at a location as shown in FIG. 1A that is the same fixed distance $d_1$ from right edge 35. In addition, as seen in FIG. 1A, the location of signaling component 20 identified as 1 is a different distance from top edge 40 than the location of signaling component 20 identified as 3 (i.e., they are vertically offset from one another). Similarly, the location of signaling component 20 identified as 2 is a different distance from bottom edge 45 than signaling component 20 identified as 4 (i.e., they are vertically offset from one another).

On feeder tray 5, detecting device 15 identified as A is located the distance $d_1$ from left edge 50 of feeder tray 5, and detecting device 15 identified as B is located the distance $d_2$ from left edge 50 of feeder tray 5. In addition, detecting device 15 identified as C is located a distance from left edge 50 that places it the distance $d_2$ from point 55 of feeder tray 5, and detecting device 15 identified as D is located a distance from left edge 50 that places it the distance d1 from point 55 of feeder tray 5. Point 55 of feeder tray 5 is located a distance from left edge 50 equal to the width, measured from left edge 30 to right edge 35, of print medium 10. Print head 100 is located above feeder tray 5 and printer tray 101 is located below feeder tray 5. As will be appreciated, the width of print medium 10 will be uniform among all such print media of the same type because, as noted above, print medium 10 is a standard size print medium.

Figure 1B:
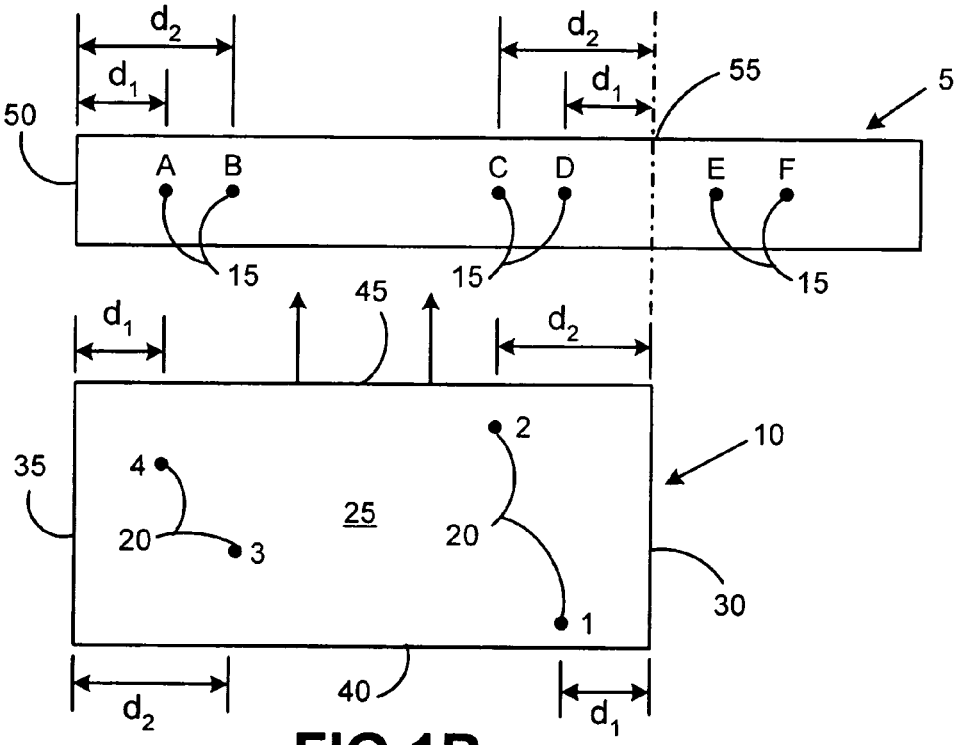

Thus, due to the placement of detecting devices 15 described above, as seen in FIG. 1A, when print medium 10 is placed on and fed over feeder tray 5 top edge 40 first (with left edge 30 aligned with left edge 50), signaling component 20 identified as 1 will be aligned with and will pass over detecting device 15 identified as A, signaling component 20 identified as 2 will be aligned with and will pass over detecting device 15 identified as B, signaling component 20 identified as 3 will be aligned with and will pass over detecting device 15 identified as C, and signaling component 20 identified as 4 will be aligned with and will pass over detecting device 15 identified as D. As a result, software in the printer that includes feeder tray 5 can be programmed to recognize that print media 10 is being fed top edge 40 first (as in FIG. 1A) if the order in which detecting devices 15 are triggered (meaning they detect a signaling component 20) is as follows: A, C, D, B. In addition, FIG. 1B shows feeder tray 5 and print medium 10 wherein print medium 10 has been flipped around such that bottom edge 45 is on top. The software in the printer including feeder tray 5 can be programmed to recognize that print media 10 is being fed bottom edge 45 first if the order in which detecting devices 15 are triggered is as follows: C, A, B, D. This ability to detect the feed orientation (top edge 40 first or bottom edge 45 first) is made possible by the placement and offset of signaling components 20 on print medium 10 that results in a different order of detection device 15 triggering depending upon the feed orientation. While one possible scheme of placement and orientation of signaling components 20 is shown in FIGS. 1A and 1B, it will be understood by those of skill in the art that other acceptable schemes are possible (each one resulting in a different order of detection device 15 triggering depending upon the feed orientation).

Once the feed orientation has been detected, appropriate action can be taken to ensure that the printed matter is printed properly (in the proper location and with the proper orientation) on print medium 10. In one embodiment, the printer that includes feeder tray 5 sends the detected feed orientation to the computer that requested printing, and the computer in turn sends a print rendering of the printed matter that is proper for the given feed orientation, which rendering is then used to properly print the printed matter onto print medium 10. In another embodiment, when the computer in question requests that printed matter be printed, it sends a print rendering that is proper for both possible feed orientations, and the printer that includes feeder tray 5 chooses the appropriate print rendering based on the detected feed orientation, which rendering is then used to properly print the printed matter onto print medium 10. In yet another embodiment, the printer that includes feeder tray 5 is provided with a paper handling system that is capable of changing the feed orientation of print medium 10. Such printers are known in the art are commercially available from companies such as Hewlett Packard. In this embodiment, the computer that requests printing sends a known, default print rendering (one that is appropriate for a particular feed orientation, e.g., top edge 40 first) to the printer, which then uses the paper handling system to change the feed orientation of print medium 10 if the detected feed orientation does not match the feed orientation associated with the default print rendering. If the detected feed orientation does match the feed orientation associated with the default print rendering, no change is made. The default print rendering can then be used to properly print the printed matter onto print medium 10.

According to a further feature of the present invention, detecting devices 15 can also be used to detect whether print medium 10 is being fed with the proper side thereof facing up, which in the case of the embodiment of feeder tray 5 and the associated printer described in connection with FIGS. 1A and 1B, is front surface 25. In particular, as described above, certain detecting devices 15 that may be utilized in the present invention rely on the reflection of light from signaling components 20 for detection. Examples of such detecting devices are infrared LED transmitters/receivers that are used with carbon ink spot type signaling components 20 and an infrared or ultraviolet detectors that are used with non-visible ink spot type signaling components. If print medium 10 is fed with front surface 25 facing down (and thus signaling components 20 facing up) when these types of detecting devices 15 are used in feeder tray 5, the detecting devices 15 will not detect any signaling components (no light will be reflected from them). In this case, the printer associated with feeder tray 5 may be programmed to recognize that such a situation means that print medium 10 is being fed with the wrong side facing down, in which case it can reject print medium 10 and signal the user that print medium 10 should be flipped, or alternatively, it can use a paper handling system (if provided) to automatically flip print medium 10 over. Once print medium 10 is flipped over, the feed orientation can be detected as described herein and utilized to ensure proper printing as described above.

According to yet another alternative embodiment, a set of redundant detecting devices 15 are provided in a location spaced above and aligned with each of detecting devices 15 shown in FIG. 1A and 1B (they may be suspended or supported by some type of bar or frame attached to feeder tray 5) such that print medium 10 will be fed between the detecting devices 15 shown in FIG. 1A and 1B and the redundant detecting devices 15. In this embodiment, a determination as to whether print medium 10 is being fed with front surface 25 facing up or down (against feeder tray 5) can be made based on which set of detecting devices 15 detects signaling components 20. This embodiment assumes that detecting devices 15 are of the type that rely on the reflection of light to perform the detection. If the detecting devices 15 shown in FIG. 1A detect signaling components 20, then it is known that front surface 25 is facing up, whereas if the redundant detecting devices 15 detect signaling components 20, then it is known that front surface 25 is facing down. Based on this determination, print medium 10 could then be flipped as described above, and the feed orientation can be detected and utilized to ensure proper printing. Alternatively, the printer associated with feeder tray 5 may be provided with dual print heads, one that print on the bottom of print media that is fed therethrough and one that prints on the top of print media that is fed therethrough. In this embodiment, after the face up or face down determination is made, the feed orientation can be determined (using the appropriate set of detecting devices 15), and the proper print head can be activated to properly print the printed matter using the feed orientation information as described herein.

Figure 2A:
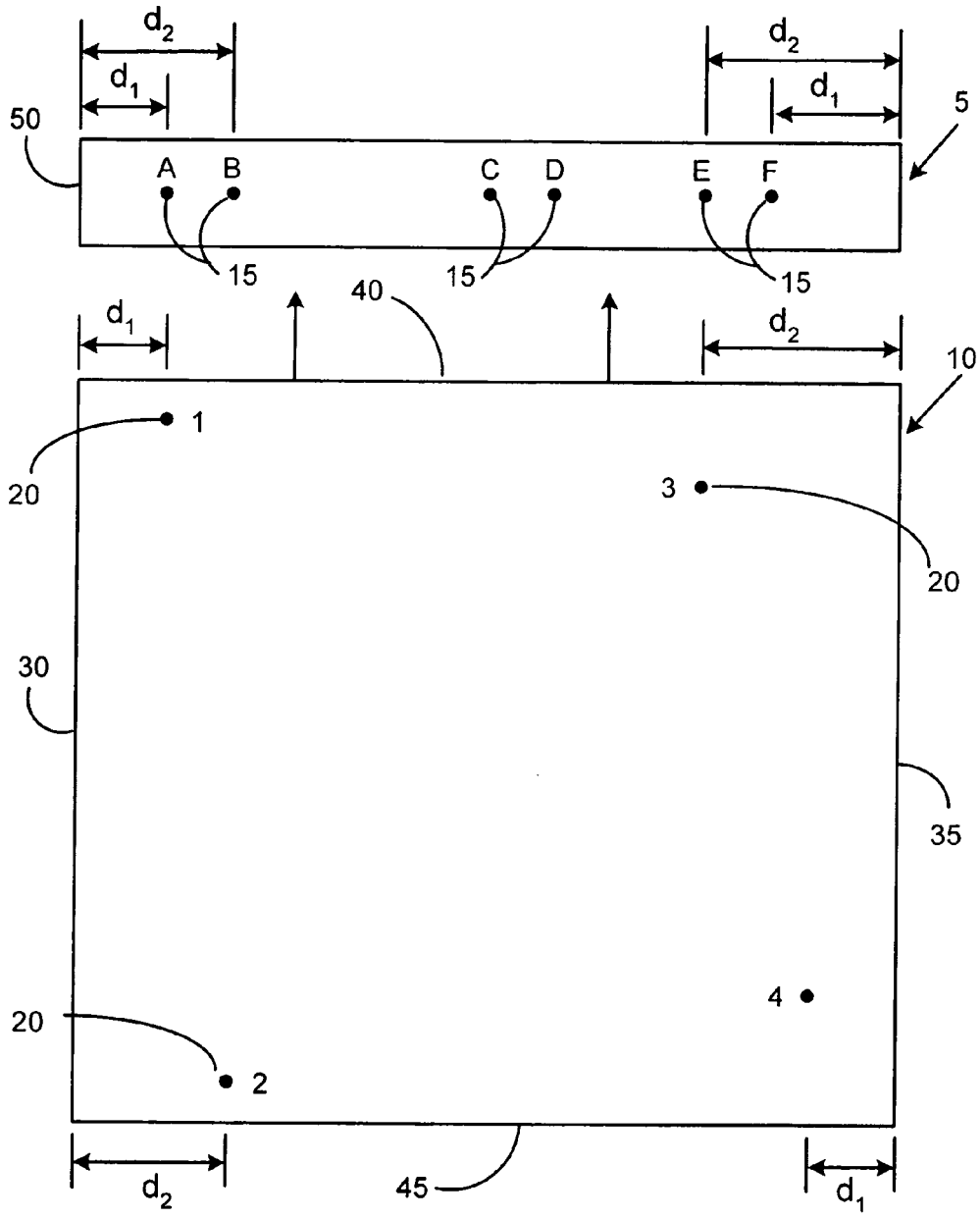
Figure 2B:
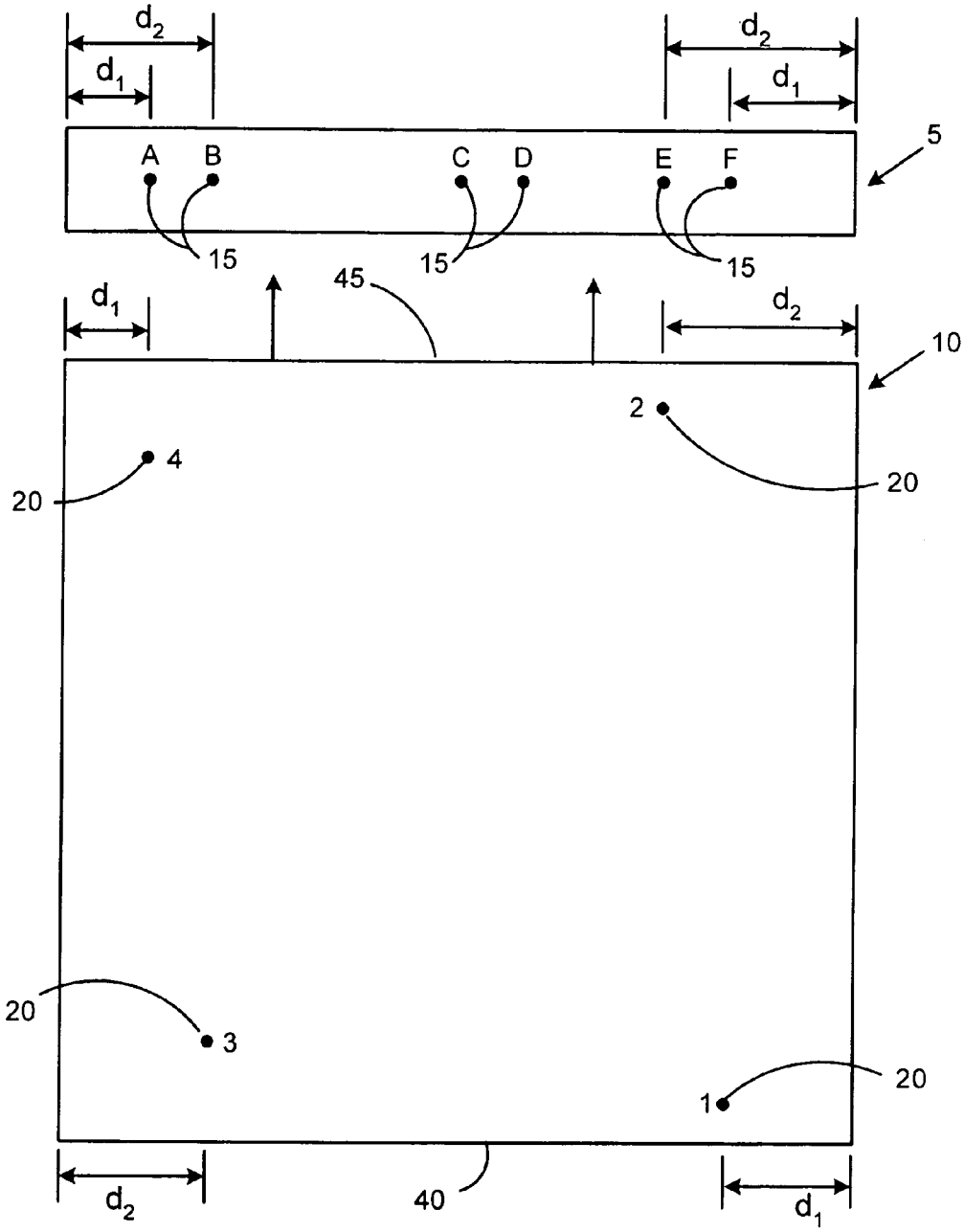

FIGS. 2A and 2B show an alternative standard size print medium 10, such as a piece of 8½×11 preprinted letterhead. Print medium 10 shown in FIGS. 2A and 2B is similar to print medium 10 shown in FIGS. 1A and 1B in that it has signaling components 20, identified as 1, 2, 3, and 4, provided on or embedded therein on a side opposite front surface 25. As seen in FIGS. 2A and 2B, the signaling components 20 are similarly placed and offset such that the feed orientation of print medium 10 may be detected using feeder tray 5, the only difference being that detecting devices 15 identified as E and F are utilized instead of detecting devices 15 identified as C and D. Detecting devices 15 identified as E and F are placed so as to be aligned with signaling components 20 identified as 3 and 4, respectively, when print medium 10 is fed top edge 40 first, and with signaling components 20 identified as 2 and 1, respectively, when print medium 10 is fed bottom edge 45 first. Thus, a top edge 40 first feed orientation may be detected when the following order of detecting device 15 triggering occurs: A, E, F, B, and a bottom edge 45 first feed orientation may be detected when the following order of detecting device 15 triggering occurs: E, A, B, F. Otherwise, the operation and functionality is the same as described in connection with FIGS. 1A and 1B.

Figure 3A:
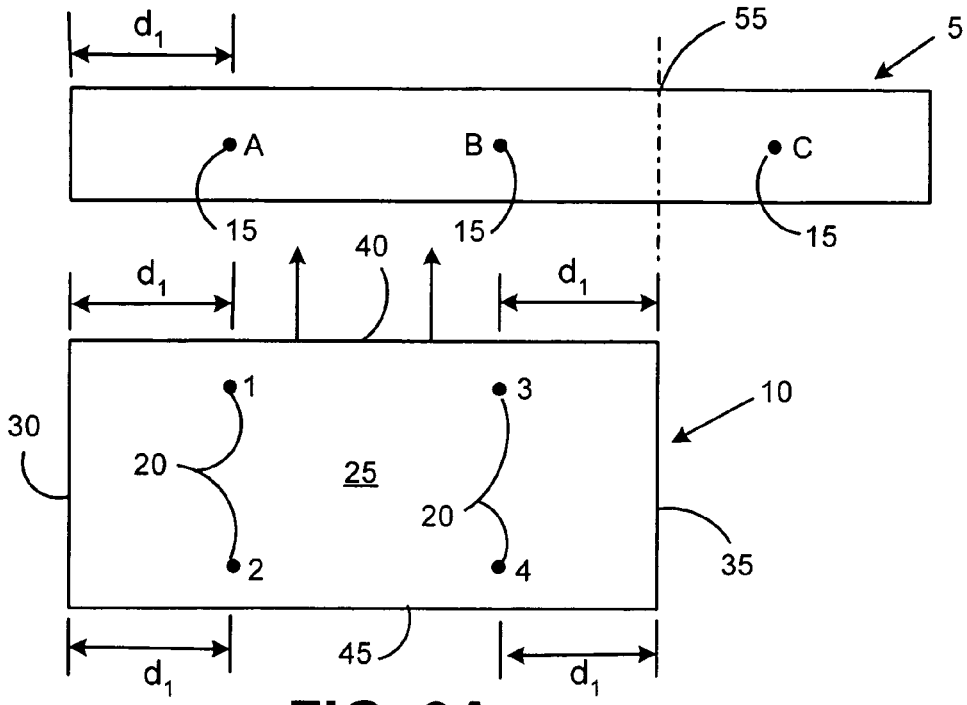
FIGS. 3A, 3B, 4A, and 4B are block diagrams of a system for ensuring proper printing of printed matter onto a print medium according to an alternate embodiment of the present invention.
Figure 3B:
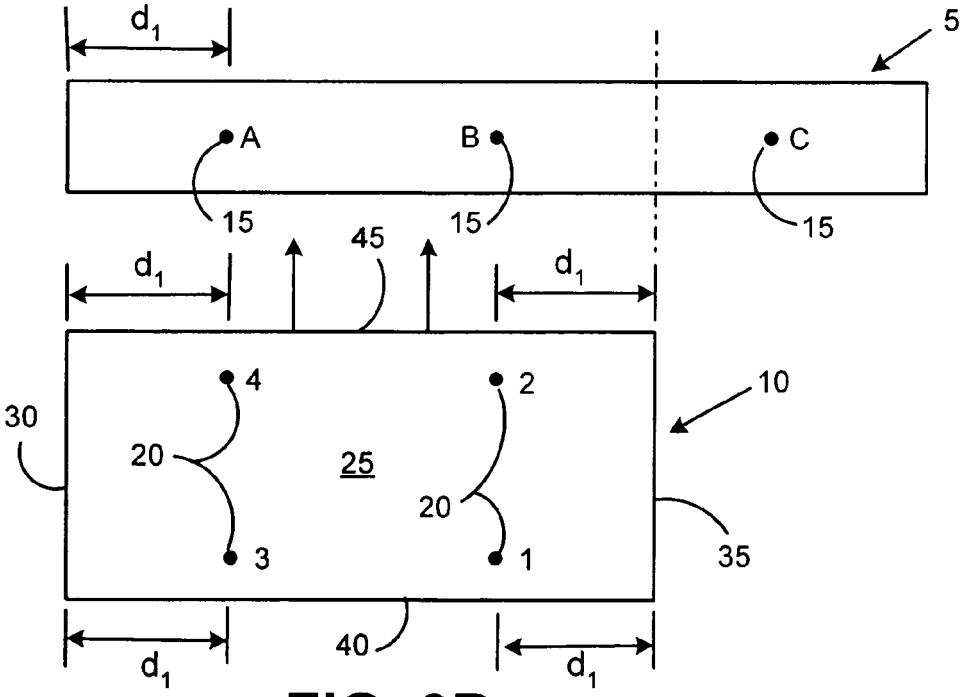

FIGS. 3A and 3B show feeder tray 5 and standard size print medium 10, such as a #10 envelope, according to an alternative embodiment of the present invention. Print medium 10 in this embodiment is provided with signaling components 20 (identified as 1, 2, 3 and 4), wherein signaling components 20 identified as 1 and 2 are positioned a distance $d_1$ from left edge 30 as shown, and signaling components 20 identified as 3 and 4 are positioned the same distance $d_1$ from right edge 35 as shown. Signaling components 20 in this embodiment are of a type that store or otherwise contain identifying information that identifies the particular signaling component 20 (e.g., 1) and distinguishes it from the other signaling components 20 (e.g., 2, 3 and 4). An example of such a signaling component 20 is an RFID tag embedded in print medium 10. Such RFID tags are able to store identifying information therein that is transmitted to a detecting device 15 in the form of an RFID reader when the RFID tag is within the range of the RFID reader. Such identifying information may be an explicit identification of the location of the signaling component, such as upper left for signaling component 20 identified as 1, upper right for signaling component 20 identified as 3, lower left for signaling component 20 identified as 2, and lower right for signaling component 20 identified as 4, or simply an identification by a number or the like. Alternatively, signaling components 20 in this embodiment may each be a non-visible ink spot, provided on the side opposite front surface 25, of a different color or that reflects light of a different frequency, wherein the particular color or frequency identifies the particular signaling component 20. For example, signaling component 20 identified as 1 may be a first color or frequency that represents upper left, signaling component 20 identified as 2 may be a second color or frequency that represents lower left, signaling component 20 identified as 3 may be a third color or frequency that represents upper right, and signaling component 20 identified as 4 may be a fourth color or frequency that represents lower right. In this embodiment, detecting devices 15 are each in the form of four photo detectors, each one of which is able to detect a particular one of the colors or frequencies associated with signaling components 20. Thus, each such detecting device 15 (consisting of four photodetectors) is able to detect which of the signaling components 20 is in proximity therewith based upon which one of the photodetectors detects reflected light (the reflected light will be of a particular color or frequency depending on the particular signaling component 20 and will activate a particular one of the photodetectors).

Thus, in the embodiment shown in FIGS. 3A and 3B, detecting devices 15 are located on feeder tray 5 in positions that will align them with respective signaling components 20 when print medium 10 is fed over feeder tray 5. As a result, when print medium 10 is fed top edge 40 first as shown in FIG. 3A, detecting device 15 identified as A will first detect signaling component 20 identified as 1 (e.g., upper left identifying information) and then detect signaling component 20 identified as 2 (e.g., lower left identifying information), and detecting device 15 identified as B will first detect signaling component 20 identified as 3 (e.g., upper right identifying information) and then detect signaling component 20 identified as 4 (e.g., bottom right identifying information). The printer that includes feeder tray 5 may be programmed to recognize a top edge 40 first feed orientation when this sequence of detection occurs. Conversely, when print medium 10 is fed bottom edge 45 first as shown in FIG. 3B, detecting device 15 identified as A will first detect signaling component 20 identified as 4 (e.g., bottom right identifying information) and then detect signaling component 20 identified as 3 (e.g., top right identifying information), and detecting device 15 identified as B will first detect signaling component 20 identified as 2 (e.g., lower left identifying information) and then detect signaling component 20 identified as 1 (e.g., upper left identifying information). The printer that includes feeder tray 5 may be programmed to recognize a bottom edge 45 first feed orientation when this sequence of detection occurs. Once the feed orientation is determined, it may then be utilized in the manner or manners described elsewhere herein to ensure proper printing of the printed matter onto print medium 10.

Figure 4A:
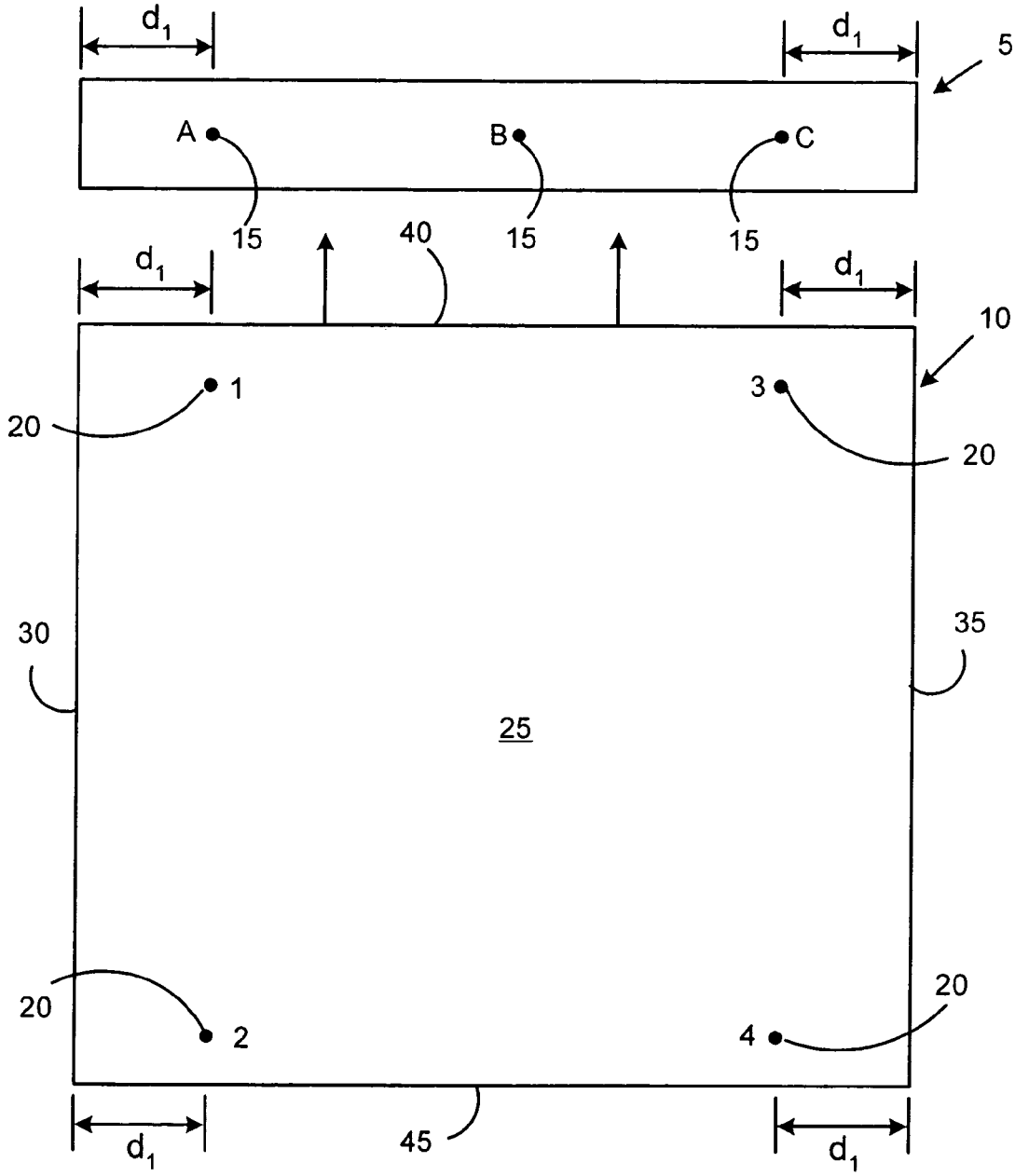
Figure 4B:
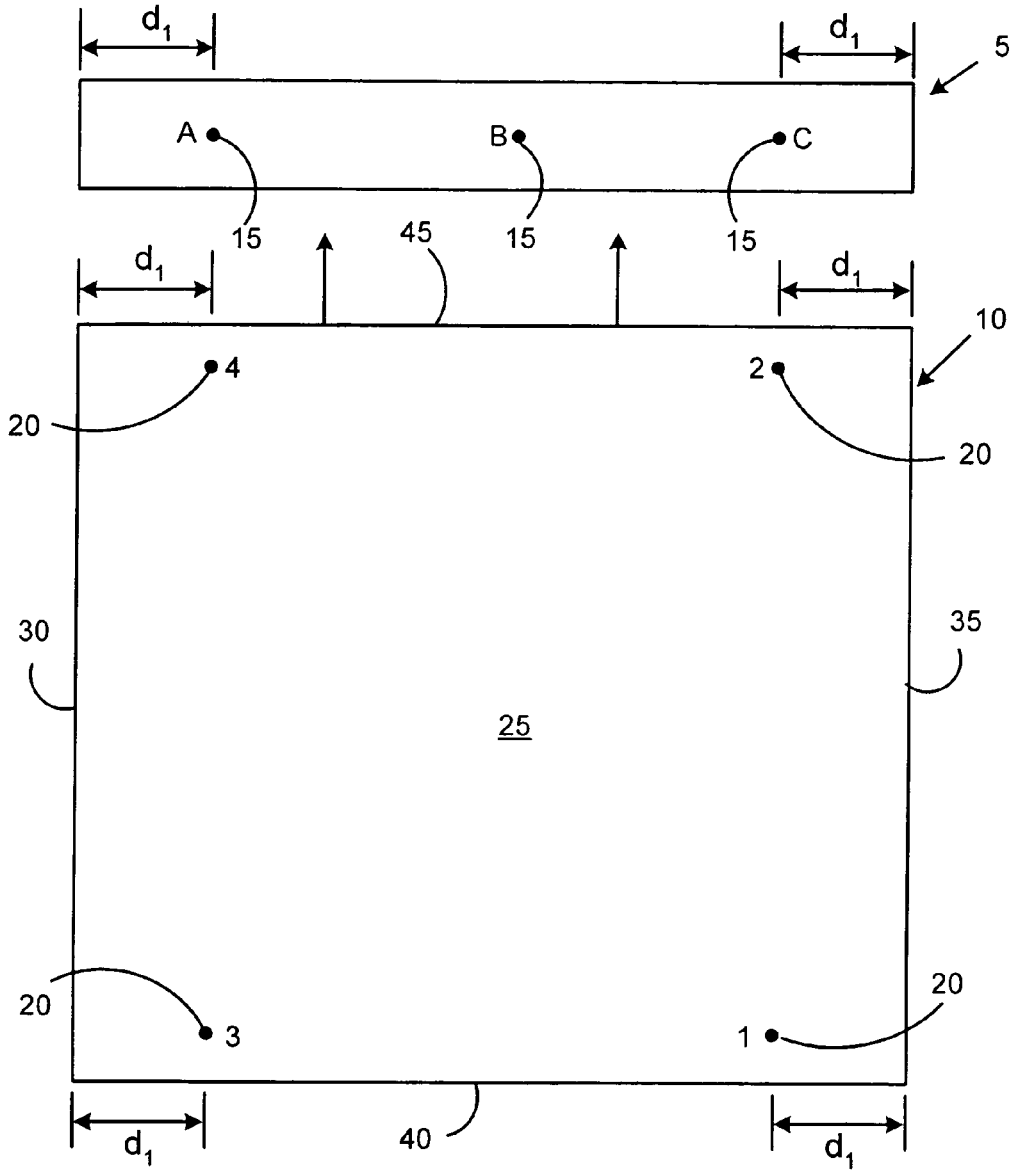

FIGS. 4A and 4B show a variation of the embodiment of the present invention described in connection with FIGS. 3A and 3B wherein an alternative standard size print medium 10, such as a piece of 8½×11 preprinted letterhead, is used. Print medium 10 shown in FIGS. 4A and 4B is similar to print medium 10 shown in FIGS. 3A and 3B in that it includes signaling components 20 that are of a type that store or otherwise contain identifying information as described herein. The only difference between the invention as shown in FIGS. 3A and 3B and the invention as shown in FIGS. 4A and 4B is that in the latter, detecting device 15 identified as C is utilized instead of detecting device 15 identified as B to accommodate the width of print medium 10. Otherwise, the functioning is the same.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A system for ensuring that printed matter is properly printed on a print medium comprising:

a printer having a feeding device for facilitating the feeding of said print medium into said printer and first and second print heads, said feeding device having a top portion and a bottom portion, said print medium being fed in between said top portion and said bottom portion; and a plurality of first detecting devices disposed along a length of said bottom portion of said feeding device and a plurality of second detecting devices disposed along a length of said top portion of said feeding device;

said print medium having a plurality of signaling components, each of said first and second detecting device being able to detect the presence of each of said signaling components when each of said signaling components is in proximity to said detecting device;

wherein said system determines a first feed orientation of said print medium based on either an order in which each of said first detecting devices detects the presence of a respective one of said signaling components or an order in which each of said second detecting devices detects the presence of a respective one of said signaling components when said print medium is being fed into said printer between said top and bottom portions and wherein said printer causes said printed matter to be printed in a proper location and in a proper orientation on said print medium based on said first feed orientation using said first print head if said first detecting devices detect said signaling components and said second print head if said second detecting devices detect said signaling components.

2. A system according to claim 1, said first print head being adapted to print on a first surface of said print medium and said second print head being adapted to print on a second surface of said print medium, said first surface being opposite said second surface.

3. A system according to claim 1, said printer printing said printed matter using a print rendering appropriate for said first feed orientation.

4. A system according to claim 1, said printer printing said printed matter using a print rendering, said printer further comprising a paper handling system, said paper handling system changing said print medium from said first feed orientation to a second feed orientation if said print rendering is appropriate for said second feed orientation and not appropriate for said first feed orientation.

5. A system according to claim 1, said signaling components being ink spots, said detecting devices being infrared LED transmitters/receivers.

6. A system according to claim 1, said signaling components being RFID tags, said detecting devices being RFID receivers.

* * * * *